US007622234B2

(12) United States Patent
Vanbesien et al.

(10) Patent No.: US 7,622,234 B2
(45) Date of Patent: Nov. 24, 2009

(54) EMULSION/AGGREGATION BASED TONERS CONTAINING A NOVEL LATEX RESIN

(75) Inventors: Daryl Vanbesien, Burlington (CA); Ke Zhou, Mississauga (CA); Guenno G Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 603 days.

(21) Appl. No.: 11/094,421

(22) Filed: Mar. 31, 2005

(65) Prior Publication Data

US 2006/0222989 A1 Oct. 5, 2006

(51) Int. Cl.
*G03G 9/00* (2006.01)

(52) U.S. Cl. ..... 430/109.3; 430/109.2

(58) Field of Classification Search ..... 428/829
See application file for complete search history.

(56) References Cited

U.S. PATENT DOCUMENTS 3,990,980 A * 11/1976 Kosel ..... 430/113
5,275,918 A * 1/1994 Held et al. ..... 430/291
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,256 A 7/1997 Veregin et al.
5,723,523 A 3/1998 Engelhardt et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,858,601 A 1/1999 Ong et al.
5,863,698 A 1/1999 Patel et al.
5,869,215 A 2/1999 Ong et al.
5,902,710 A 5/1999 Ong et al.
5,905,114 A * 5/1999 Baumstark et al. ..... 524/801
5,910,387 A 6/1999 Mychajlowskij et al.
5,916,725 A 6/1999 Patel et al.
5,919,595 A 7/1999 Mychajlowskij et al.
5,925,488 A 7/1999 Patel et al.
5,977,210 A 11/1999 Patel et al.
6,200,715 B1 * 3/2001 Fuller et al. ..... 430/59.6
6,376,057 B1 * 4/2002 Akao et al. ..... 428/215
7,279,261 B2 * 10/2007 Lee et al. ..... 430/109.3
2002/0076637 A1 6/2002 Iwa et al.
2003/0152857 A1 * 8/2003 Sugiura et al. ..... 430/109.2
2003/0175046 A1 * 9/2003 Namiki et al. ..... 399/176
2003/0190547 A1 * 10/2003 Kobayashi et al. ..... 430/125
2003/0198883 A1 * 10/2003 Hiratsuka et al. ..... 430/109.3
2004/0059046 A1 * 3/2004 Hanna et al. ..... 524/515
2004/0161688 A1 * 8/2004 Itakura et al. ..... 430/108.4
2004/0259012 A1 * 12/2004 Fujikawa et al. ..... 430/109.2
2005/0084787 A1 * 4/2005 Kobayashi et al. ..... 430/125
2006/0222989 A1 * 10/2006 Vanbesien et al. ..... 430/109.2

FOREIGN PATENT DOCUMENTS

EP 1 197 805 A2 4/2002
EP 1 437 629 A2 7/2004
EP 1 462 860 A2 9/2004

* cited by examiner

*Primary Examiner*—D. Lawrence Tarazano
*Assistant Examiner*—Gary Harris
(74) *Attorney, Agent, or Firm*—Oliff & Berridge, PLC

(57) ABSTRACT

A toner is disclosed that includes a toner binder of a styrene/acrylate resin containing carboxylic acid substituents and epoxy substituents, and optionally a colorant and/or wax. The carboxylic acid substituents act as a curing agent and react with the epoxy substituents, causing rapid crosslinking of the toner. Curing occurs during the fusing process and at a temperature greater than 100° C.

20 Claims, No Drawings

EMULSION/AGGREGATION BASED TONERS CONTAINING A NOVEL LATEX RESIN

BACKGROUND

Described herein are toner processes, and more specifically, aggregation and coalescence processes, for the preparation of toner compositions. More particularly, described are methods of reacting toner components during the fusing process to provide a more permanent image and to improve document offset and crease properties.

Document offset refers to how well the toner remains on the image recording medium, such as paper or a package, after the image has been printed. This is particularly important when the printed items are stacked upon each other. Crease property refers to how well an image avoids cracking when the image is folded or creased.

Existing toners often lack the ability to permanently remain on a medium after printing. It's especially important for an image printed on a material to be used in packaging to be permanent as packages are frequently bent and twisted.

In forming an image on a package or on a label to be attached to a package, the image is printed onto the medium. Once the image is printed, the medium with the image thereon is heated to fuse the image onto the recording medium, e.g., cardboard box or label. Once an image is printed, an overcoat varnish may be placed over the image. The varnish may be crosslinked to increase the molecular weight of the varnish and make the varnish seal more permanent.

For forming the image, toners such as emulsion aggregation toners may be used. Such a toner is prepared by the well known emulsion aggregation technique. This technique or process for the preparation of toner is illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. Also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,910,387; 5,919,595; 5,916,725; 5,902,710; 5,863,698, 5,925,488; 5,977,210 and 5,858,601. The appropriate components and process parameters of the above Xerox patents may be selected for use in embodiments described herein.

SUMMARY

This disclosure proposes a reactive emulsion/aggregation (EA) toner, wherein components of the toner react during the fusing process. More specifically, the toner is comprised of styrene/acrylate resin containing at least an epoxy group containing material and a carboxylic acid group containing material.

The reaction or curing is initiated during fusing at a temperature of at least greater than 100° C., and preferably between 100° C. and 170° C., and a reaction occurs between the epoxy group and the carboxylic acid group components such that there is crosslinking therebetween. Thus, a crosslinked toner is formed during fusing.

The two components are typically each low molecular weight materials, such that low viscosity is attained at low temperatures. However, after melting and curing on the image recording medium, e.g., paper product, etc., crosslinking will occur. The crosslinking produces high mechanical properties or a low fracture coefficient of the toner. In other words, document offset properties and crease properties are improved.

Thus, the styrene/acrylate EA latex resin comprising the epoxy substituents and carboxylic acid substituents allows crosslinking of the resin during the fusing process. The aim is to combine low minimum fixing temperature (MFT) of the uncrosslinked resin with scratch resistance and improved document offset of the crosslinked resin for improved toners. These toners are especially suitable for use in packaging applications.

In other words, low molecular weight before fusing allows for a low MFT. However, after fusing, crosslinking occurs providing a high molecular weight which provides improved document offset and scratch resistance. Thus, when crosslinking occurs in the fusing process rather than during toner preparation, these benefits are achieved.

DETAILED DESCRIPTION OF EMBODIMENTS

Low molecular weight toner resins achieve the desired flow properties at low temperatures in order to wet or penetrate the recording medium or substrate, such as paper, paper board, or packaging materials such as plastic, glass, aluminum foil, metal or tin cans and the likes. Once melted and cooled on the recording medium, the low molecular weight toner resins display a range of gloss, especially high gloss, but with poor mechanical properties, such as poor crease properties, and high fracture coefficients as well as poor scratch resistance and poor offset properties. High fracture coefficient indicates that the fused image will fracture easily. High molecular weight toners, display higher mechanical properties and lower fracture coefficient, however, higher viscosity properties, must be processed at higher temperatures in order to wet and penetrate the paper fibers. A higher fracture molecular weight improves the fracture coefficient.

In order to permit use of low fusing temperatures, it is desirable to use low viscosity toner resins. After or during the melting onto the paper fibers, it is desirable to transform the toner resin into high molecular weight such as by crosslinking or a curing process, in order to improve its mechanical properties such decreasing its fracture coefficient and thus resulting in excellent crease property, document offset properties or scratch resistance.

The toner utilizes a resin system having low molecular weight prior to fusing. Upon fusing, the resin includes substitutes to form a high molecular weight toner resin. Generally, even before fusing, resins are known to begin to cure in the presence of a curing agent such as amines, alcohols or acids at temperatures as low as about 70° C. In contrast, a toner using a binder, such as a styrene/acrylate latex, containing both epoxy substituents and carboxylic acid substituents in accordance with the present disclosure will primarily cure or crosslink during fusing only when the temperature reaches at least 100° C.

Prior to the fusing process, the toner binder is preferably substantially free of crosslinking. The toner binder may include small percentages of physical or ionic crosslinked portions of the toner resin. Physical or ionic crosslinking can be described more accurately by weak ionic bonding through functional moieties such as hydrogen bonding from the carboxylic acid moieties or metal salts such as sodio or lithio sulfonate moieties. However, substantially no chemical crosslinking is present until the desired temperature is reached, and curing of the toner resin is initiated during fusing of a printed image.

Upon heating, the carboxylic acid substituents will act as a curing agent and will react with the epoxy substituents. This will cause rapid crosslinking of the toner, and provide superior mechanical properties. While a curing or catalytic agent is not necessary, one may be added if desired.

The crosslinking preferably occurs only during or after the fusing process, i.e., when the image is formed on the image recording means. Crosslinking preferably does not occur until the toner reaches the temperature of at least 100° C., and more preferably between about 100° C. and about 170° C.

The resin system of the toner may be any system that includes therein both epoxy substituents and carboxylic acid substituents. These groups may be present in a single resin material (i.e., as different parts of the same resin chain) or as two separate components.

A preferred resin is, e.g., a styrene/acrylate resin having the following general structure

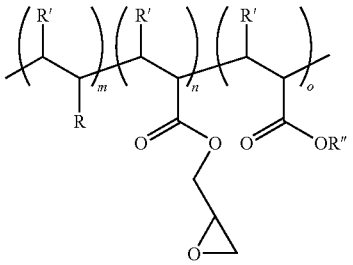

wherein R is a mixture of phenyl and carboxy-alkylate substituent, R' is a hydrogen or methyl substituent, and R" is a hydrogen or ethylcarboxylic acid substituent, and m, n and o are integers that represent segmental units of the resin that are randomly distributed within the resin.

The styrene/acrylate resin may have, for example, a number average molecular weight (MN), as measured by gel permeation chromatography (GPC) of, for example, from about 1,000 to about 50,000, and preferably from about 2,000 to about 25,000. The weight average molecular weight (MW) of the resin may be, for example, from about 2,000 to about 100,000, and preferably from about 3,000 to about 80,000, as determined by GPC.

A preferred styrene/acrylate resin includes styrene present in the amount of about 65 to about 85 weight percent, and acrylate present in the amount of about 15 to about 35 weight percent. Further, a styrene/acrylate monomer includes epoxy substituents present in the amount of about 5 to about 10 weight percent, preferably about 7.5 weight percent, and carboxylic acid substituents present in the amount of about 1.5 weight percent to about 6 weight percent, preferably 3 weight percent.

Illustrative examples of specific latex resin, polymer or polymers selected for use herein include poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid).

The present disclosure is further directed to the economical chemical in situ preparation of toners without the utilization of the known pulverization and/or classification methods, and wherein toner compositions with a volume average diameter of from about 1 to about 25 microns, and more specifically, from about 1 to about 10 microns and narrow geometric size distribution (GSD), of, for example, from about 1.14 to about 1.25 each as measured on the Coulter Counter, can be obtained. The resulting toners can be selected for know electrophotographic imaging, digital, printing processes, including color processes, and lithography.

The resin may be made by any suitable method. A preferred method is described below for illustration. First, a surfactant solution is prepared by combining an anionic surfactant with water. The anionic surfactant is present in the amount from about 0.01 to about 15, or more preferably from about 0.01 to about 5 weight percent of the reaction mixture.

Surfactants for the preparation of latexes and colorant dispersions can be ionic or nonionic surfactants in effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. Examples of nonionic surfactants for the colorant dispersion selected in various suitable amounts, such as about 0.1 to about 5 weight percent, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

In a separate container, an initiator solution is prepared. Examples of initiators for the preparation of the latex include water soluble initiators, such as ammonium and potassium persulfates in suitable amounts, such as from about 0.1 to about 8 weight percent, and more specifically, in the range of from about 0.2 to about 5 weight percent. The latex includes both the initial latex and the added delayed latex wherein the delayed latex refers, for example, to the latex portion which is added to the already preformed aggregates in the size range of about 4 to about 6.5 μm, as described below.

In yet another container, a monomer emulsion is prepared by mixing styrene, alkyl acrylate and/or alkyl methacrylate, glycidyl acrylate and/or glycidyl methacrylate, acrylic acid, methacrylic acid and/or β-carboxyethylacrylate, and surfactant. In one embodiment, the styrene, the alkyl acrylate and/or alkyl methacrylate, the glycidyl acrylate and/or glycidyl methacrylate, and the acrylic acid, methacrylic acid and/or β-carboxyethylacrylate are olefinic monomers.

Glycidyl acrylate or glycidyl methacrylate is present in the monomer emulsion in the range of about 4 weight percent to about 30 weight percent. Acrylic acid or β-carboxyethylacrylate is present in the monomer emulsion in the range of about 1 weight percent to about 10 weight percent. Styrene is present in the monomer emulsion in the range of about 65 to about 85 weight percent. Acrylate is present in the monomer emulsion in the range of about 15 to about 35 weight percent.

Once the preparation of the monomer emulsion is complete, a small portion, for example, approximately 0.5 to 5 percent of the emulsion, is slowly fed into a reactor containing the surfactant solution. The initiator solution is then slowly added into the reactor. After approximately 15 to 45 minutes, the remainder of the emulsion is added into the reactor.

After about 1 to 2 hours, but before all of the emulsion is added to the reactor, 1-dodecanethiol (a chain transfer agent that controls/limits the length of the polymer chains) is added to the emulsion. The emulsion is continued to be added into the reactor.

Toner particles are preferably prepared by aggregating and coalescing the styrene/acrylate resin by any of the known emulsion/aggregation techniques. Preparation of the particles is not limited to such techniques. The toners may be made by a variety of known methods. Most preferably, however, the toners are made by the well known aggregation and coalescence process in which small size resin particles are aggregated to the appropriate toner particle size and then coalesced to achieve the final toner particle shape and morphology.

Toners can be prepared using the styrene/acrylate resin by combining it with a pigment or colorant, a coagulant and optionally a wax and/or charge control agent. If desired, additional curing agents and catalysts can be added to the system such as polyfunctional amines. Any other conventional additives may also be included.

As one example process, the toners may be prepared by a process that includes aggregating a mixture of a colorant, optionally a wax and any other desired or required additives, and emulsion(s) comprising the styrene/acrylate resin, and then coalescing the aggregate mixture. A pre-toner mixture is prepared by adding the colorant, and optionally a wax or other materials, to the emulsion, which may be a mixture of two or more emulsions containing the toner binder resin. In various embodiments, the pH of the pre-toner mixture is adjusted to between about 4 to about 5. The pH of the pre-toner mixture may be adjusted by an acid such as, for example, acetic acid, nitric acid or the like. Additionally, in various embodiments, the pre-toner mixture optionally may be homogenized. If the pre-toner mixture is homogenized, homogenization may be accomplished by mixing at about 600 to about 4,000 revolutions per minute. Homogenization may be accomplished by any suitable means, including, for example, an IKA Ultra Turrax T50 probe homogenizer.

Following the preparation of the pre-toner mixture, an aggregate mixture is formed by adding an aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent is added to the pre-toner mixture at a temperature that is below the glass transition temperature ($T_g$) of the emulsion resin. Preferably, the aggregating agent is added in an amount of about 0.05 pph to about 3.0 pph with respect to multivalent cation and from about 1.0 to about 10 pph with respect to the divalent cation wherein the pph is with respect to weight of toner. The aggregating agent may be added to the pre-toner mixture over a period of from about 0 to about 60 minutes. Aggregation may be accomplished with or without maintaining homogenization. Aggregation is accomplished at temperatures that are preferably greater then 60° C.

The surfactant stabilizes the particles by either electrostatic or steric forces or both, to prevent massive flocculation, when the aggregating agent is added. The pH of the blend containing the blend of toners, pigment, optional additives (wax), etc. is adjusted from about 5.6 to about 3.0 with 0.1 M nitric acid, followed by the addition of PAC, while being polytroned at speeds of about 5000 rpm. The temperature of the mixture is raised from room temperature to 55° C., and slowly in stages to about 65° C. in order to coalesce the particles.

Following aggregation, the aggregates are coalesced. Coalescence may be accomplished by heating the aggregate mixture to a temperature that is about 5 to about 20° C. above the $T_g$ of the emulsion resin. Generally, the aggregated mixture is heated to a temperature of about 50 to about 80° C. In various embodiments, coalescence is accomplished by also stirring the mixture of from about 200 to about 750 revolutions per minute. Coalescence may be accomplished over a period of from about 3 to about 9 hours.

Optionally, during coalescence, the particle size of the toner particles may be controlled and adjusted to a desired size by adjusting the pH of the mixture. Generally, to control the particle size, the pH of the mixture is adjusted to between about 5 to about 7 using a base such as, for example, sodium hydroxide.

After coalescence, the mixture is cooled to room temperature. After cooling, the mixture of toner particles is washed with water and then dried. Drying may be accomplished by any suitable method for drying, including freeze drying. Freeze drying is typically accomplished at temperatures of about −80° C. for a period of about 72 hours.

Following formation of the toner particles, external additives may be added to the toner particle surface by any suitable procedure such as those well known in the art.

Various known colorants, such as pigments, present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours and Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans that may be selected include copper tetra (octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, Yellow 180 and Permanent Yellow FGL, wherein the colorant is present, for example, in the amount of about 3 to about 15 weight percent of the toner. Organic dye examples include known suitable dyes, reference the Color Index, and a number of U.S. patents. Organic soluble dye examples, preferably of a high purity for the purpose of color gamut are Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, and more specifically, from about 5 to 20 weight percent of the toner. Colorants include pigment, dye, mixtures of pigment and dyes, mixtures of pigments, mixtures of dyes, and the like.

Examples of waxes include polypropylenes and polyethylenes commercially available from Allied Chemical and Petrolite Corporation, wax emulsions available from Michaelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of functionalized waxes include amines, amides, imides, esters, quaternary amines, carboxylic acids or acrylic polymer emulsion, for example JONCRYL 74, 89, 130, 537, and 538, all available from SC Johnson Wax, chlorinated polypropylenes and polyethylenes commercially available from Allied Chemical and Petrolite Corporation and SC Johnson wax.

Examples of curing agents include, but are not limited to Nacure® XC-7231, Nacure® A233, Nacure® A202, Nacure® A218, Nacure® XC-9206, Nacure® XC-9223, Nacure® XC-A230, all commercially available from King Industries.

The prepared toner compositions can be used in forming images via any suitable image formation process device or engine. The toner is applied to a recording medium to form an image and then this image is heated to fuse the image onto the image recording medium. By fusing the image, crosslinking occurs between the epoxy groups and carboxylic acid groups of the toner binder. The image is fused at a temperature of at least 100° C., preferably between 100° C. and 170° C., until a sufficient amount of crosslinking has occurred. Crosslinking is sufficient when the toner no longer exhibits offset behavior, for example document or vinyl offset. Once the image is fused onto the image recording medium, a clear coat can be applied to the image for further protection.

Toner compositions and processes for producing such toners according to the described embodiments are further illustrated by the following examples. The examples are intended to be merely further illustrative of the described embodiments.

PREPARATION OF LATEX RESIN

Example 1

A surfactant solution consisting of 0.8 grams of DOWFAX 2A1™ (anionic emulsifier) and 514 grams de-ionized water is prepared by mixing for 10 minutes in a stainless steel holding tank. The holding tank is then purged with nitrogen for 5 minutes before transferring the mixture into the reactor. The reactor is then continuously purged with nitrogen while being stirred at 300 RPM. The reactor is then heated up to 76° C. at a controlled rate and held constant.

In a separate container, 8.1 grams of ammonium persulfate initiator is dissolved in 45 grams of de-ionized water.

In a second separate container, the monomer emulsion is prepared in the following manner. 423.9 grams of styrene, 116.1 grams of n-butyl acrylate, 40.5 grams of glycidylmethacrylate, 16.2 grams of β-CEA, 378 grams of 1-dodecanethiol, 1.89 grams of decanediol diacrylate (ADOD), 10.69 grams of DOWFAX™ (anionic surfactant), and 257 grams of deionized water are mixed to form an emulsion. The ratio of styrene monomer to n-butyl acrylate monomer by weight is 78.5 to 21.5 percent.

One percent of the emulsion is then slowly fed into the reactor containing the aqueous surfactant phase at 76° C. to form the "seeds," wherein the seeds refer, for example, to the initial latex added to the reactors, while being purged with nitrogen. The initiator solution is then slowly charged into the reactor and after 20 minutes the remainder of the emulsion is continuously fed into the reactor using metering pumps.

After 100 minutes of the emulsion addition, 4.54 grams of 1-dodecanethiol was added to the emulsion, and the emulsion was continued to be charged into the reactor. Once all the monomer emulsion is charged into the main reactor, the temperature is maintained at 76° C. for an additional 2 hours to complete the reaction. Full cooling is then applied and the reactor temperature is reduced to 35° C.

The product is then collected into a holding tank. The product is collected into a holding tank after filtration through a 1 micron filter bag.

After drying a portion of the latex, the molecular properties are measured to be MW=71,200, MN=13,900 and the onset Tg is 56.7° C. The average particle size of the latex as measured by Disc centrifuge is 210 nanometer and residual monomer as measured by gas chromatography as <50 ppm for styrene and <100 ppm for n-butyl acrylate.

The rheology of the latex of Example 1 containing epoxy and carboxylic acid groups was measured using a temperature ramp from 70-200° C. at a rate of 10° C./minute. An increase in storage modulus at 140° C. indicates that crosslinking is occurring in the latex.

Example 2

A surfactant solution is prepared by mixing 0.8 grams of an anionic emulsifier and 514 grams of de-ionized water for 10 minutes in a stainless steel holding tank. The holding tank is then purged with nitrogen for 5 minutes before transferring into a reactor. The reactor is then continuously purged with nitrogen while being stirred at 300 RPM. The reactor is then heated up to 76° C. at a controlled rate and held constant.

In a separate container, 8.1 grams of ammonium persulfate initiator is dissolved in 45 grams of de-ionized water to produce an initiator solution.

In a second separate container, a monomer emulsion is prepared in the following manner: 405 grams of styrene, 135 grams of n-butyl acrylate, 40.5 grams of glycidylmethacrylate, 16.2 grams of β-CEA, 3.78 grams of 1-dodecanethiol, 1.89 grams of ADOD, 10.69 grams of an anionic surfactant, and 257 grams of deionized water are mixed to form an emulsion. The ratio of styrene monomer to n-butyl acrylate monomer by weight is 78.5 to 21.5 percent.

One percent of the above emulsion is then slowly fed into the reactor containing the aqueous surfactant phase at 70° C. to form the "seeds" of a toner product while being purged with nitrogen. The initiator solution is then slowly charged into the reactor and after 20 minutes the rest of the emulsion is continuously fed in using metering pumps. After 100 minutes of emulsion addition, 4.54 grams of 1-dodecanethiol was added to the emulsion, and the emulsion was continued to be charged into the reactor.

Once all of the monomer emulsion is charged into the main reactor, the temperature is held at 70° C. for an additional 2 hours to complete the reaction. Full cooling is then applied and the reactor temperature is reduced to 35° C. The product is collected into a holding tank after filtration through a 1 micron filter bag. After drying a portion of the latex the molecular properties are measured to be MW=103,270, MN=11,373 and the onset Tg is 51.5° C.

The average particle size of the latex is 210 nanometers and residual monomer as measured by gas chromatography as <50 ppm for styrene and not detected for n-butyl acrylate. The solids content was measured to be 43.29%.

Preparation of Toner Particles 198.1 grams of the latex produced according to Example 2 having a solids loading of 43.29 weight % are added to 402.3 grams of deionized water in a vessel and stirred using a homogenizer operating at 4,000 rpm. Thereafter, 40.1 grams of a cyan pigment dispersion having a solids loading of 17 weight % are added to the reactor, followed by drop-wise addition of 22.5 grams of a flocculent mixture containing 2.25 grams polyaluminum chloride mixture and 20.25 grams 0.02 molar nitric acid solution.

As the flocculent mixture is added drop-wise, the homogenizer speed is increased to 5,200 rpm and homogenized for an additional 5 minutes. Thereafter, the mixture is heated at 1° C. per minute to a temperature of 51° C. and held there for a period of about 1.5 to about 2 hours resulting in a volume average particle diameter of 6.0 microns as measured with a Coulter Counter.

During the heat up period, the stirrer is run at about 250 rpm and 10 minutes after the set temperature of 49° C. is reached, the stirrer speed is reduced to about 220 rpm. 80.9 grams of latex produced in Example 2 is added to the reactor mixture and allowed to aggregate for an additional period of about 30 minutes at 51° C. resulting in a volume average particle diameter of about 7.0 microns.

The pH of the reactor mixture is adjusted to pH 3.5 with 1.0 M sodium hydroxide solution followed by the addition of 2.88 grams of ethylenediaminetetraacetic acid (EDTA) having a solids loading of 39 weight %. Thereafter, the reactor mixture is heated at 1° C. per minute to a temperature of 85° C.

Following this, the reactor mixture is gently stirred at 85° C. for 3 hours to enable the particles to coalesce and spherodize. The reactor heater is then turned off and the reactor mixture is allowed to cool to room temperature at a rate of 1° C. per minute.

The toner of this mixture comprises about 95 weight percent of styrene/acrylate polymer resin, and about 5 weight percent of Pigment Blue 15:3 pigment, and has a volume average particle diameter of about 7.0 microns and a GSD of about 1.28. The particles were washed 6 times, where the 1 st wash was conducted at pH of 10 at 63° C., followed by 3 washes with deionized water at room temperature, one wash carried out at a pH of 4.0 at 40° C., and finally the last wash with deionized water at room temperature.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner comprised of toner particles, wherein the toner particles are comprised of a binder that includes at least one resin, a colorant and a wax, wherein a carboxylic acid substituent and an epoxy substituent are together in a same structure of the at least one resin, and the at least one resin is substantially non-crosslinked prior to fusing.

2. The toner according to claim 1, wherein the binder further includes a curing agent therein.

3. The toner according to claim 1, wherein the at least one resin is derived from the addition polymerization of a mixture of olefinic monomers comprised of:

styrene;

alkyl acrylate and/or alkyl methacrylate;

acrylic acid, methacrylic acid and/or β-carboxyethylacrylate; and glycidyl acrylate and/or glycidyl methacrylate.

4. The toner according to claim 1, wherein the carboxylic acid substituent is derived from an acrylic acid, methacrylic acid and/or β-carboxyethylacrylate.

5. The toner according to claim 1, wherein the epoxy substituent is derived from a glycidyl acrylate and/or a glycidyl methacrylate.

6. The toner according to claim 1, wherein the at least one resin has a crosslinking temperature greater than 100° C.

7. The toner according to claim 3, wherein the styrene is about 65 to about 85 weight percent of the binder resin and the alkyl acrylate and/or alkyl methacrylate is about 15 to about 35 weight percent of the at least one resin.

8. The toner according to claim 3, wherein the acrylic acid, β-carboxyethylacrylate and/or methacrylic acid is about 1 to about 10 weight percent of the at least one resin.

9. The toner according to claim 3, wherein the glycidyl acrylate and/or glycidyl methacrylate is about 4 to about 30 weight percent of the at least one resin.

10. The toner according to claim 1, wherein the colorant is about 3 to 15 percent and the wax is about 3 to 30 percent, wherein all components in the binder are equal to 100 percent.

11. The toner according to claim 1, wherein the colorant is a pigment.

12. The toner according to claim 1, wherein the colorant is carbon black, cyan, yellow, magenta, or mixtures thereof, and the toner isolated is from about 2 to about 25 microns in volume average diameter, and the particle size distribution thereof is from about 1.15 to about 1.30.

13. A xerographic device for producing an image via application of the toner according to claim 1 to an image recording medium.

14. A method comprising:

forming an emulsion comprising styrene, acrylate, a source for epoxy substituents, and a source for carboxylic acid substituents;

forming a mixture by adding a colorant and a wax to the emulsion;

homogenizing the mixture;

adding an aggregating agent to the mixture and aggregating the mixture to form aggregated toner particles; and coalescing the aggregated toner particles to form coalesced toner particles having a binder that includes at least one resin, wherein a carboxylic acid substituent and an epoxy substituent are together in a same structure of the at least one resin of the binder, and wherein the at least one resin is substantially non-crosslinked prior to fusing.

15. The method according to claim 14, wherein the styrene is about 65 to about 85 weight percent of the emulsion, and the acrylate is about 15 to about 35 weight percent of the emulsion.

16. The method according to claim 14, wherein the source for the epoxy substituent is a glycidyl acrylate monomer and/or a glycidyl methacrylate monomer, and wherein the source for the carboxylic acid substituent is an acrylic acid monomer, methacrylic acid monomer and/or a β-carboxyethylacrylate monomer.

17. The method according to claim 14, wherein crosslinking occurs at a temperature greater than about 100° C.

18. A process for forming an image on an image recording medium, comprising:

applying the toner according to claim 1 to an image recording medium to form an image, fusing the toner on the image recording medium, wherein the fusing causes crosslinking of the toner binder; and whereby the image is fixed on the image recording medium.

19. The process according to claim 18, wherein the fusing temperature is greater than about 100° C.

20. A toner comprised of toner particles, wherein the toner particles are comprised of a binder that includes at least one resin, a colorant and a wax, wherein a carboxylic acid substituent and an epoxy substituent are together in a same structure of the at least one resin, wherein the at least one resin is substantially non-crosslinked prior to fusing, and wherein the at least one resin has the general formula:

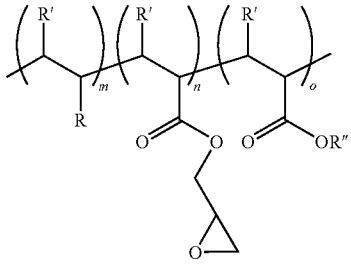

wherein R is a mixture of phenyl and carboxy-alkylate substituent, R' is a hydrogen or methyl substituent, and R'' is a hydrogen or ethylcarboxylic acid substituent, and m, n and o represent an amount of segmental units of the resin that are randomly distributed within the resin, wherein the m is from about 60 to 95 units based on 100 total units, n is from about 4 to 30 units based on 100 total units and o is from about 1 to 10 units based on 100 total units.

* * * * *